United States Patent [19]

Aguirre

[11] 4,279,591

[45] Jul. 21, 1981

[54] ADJUSTMENT GASIFICATION DEVICE FOR GAS LIGHTERS

[76] Inventor: Ricardo Aguirre, Sales y Ferrer, 7, Barcelona, Spain

[21] Appl. No.: 967,484

[22] Filed: Dec. 7, 1978

[30] Foreign Application Priority Data

Dec. 13, 1977 [ES] Spain ..... 232.677

[51] Int. Cl.[3] ..... F23Q 2/16

[52] U.S. Cl. ..... 431/344; 131/234; 431/326; 251/121

[58] Field of Search ..... 431/326, 327, 328, 344; 131/234; 251/121, 122

[56] References Cited

U.S. PATENT DOCUMENTS

| | | | |
|---|---|---|---|
| 3,092,988 | 6/1963 | Meyers | 431/344 X |
| 3,190,087 | 6/1965 | Kitabayashi | 431/344 X |
| 3,382,028 | 5/1968 | Yoshinaga | 431/344 X |
| 3,523,005 | 8/1970 | Piffata et al. | 431/344 |
| 3,620,661 | 11/1971 | Schlamp | 431/344 |
| 3,709,462 | 1/1973 | Piffata et al. | 431/344 X |
| 4,008,992 | 2/1977 | Johnsson | 431/344 |
| 4,080,156 | 3/1978 | Moriya | 431/344 |

FOREIGN PATENT DOCUMENTS

| | | | |
|---|---|---|---|
| 877427 | 8/1971 | Canada | 431/344 |
| 2100293 | 1/1972 | Fed. Rep. of Germany | 431/344 |
| 2247678 | 5/1975 | France | 431/344 |

*Primary Examiner*—Robert S. Ward,Jr.

*Attorney, Agent, or Firm*—Ostrolenk, Faber, Gerb & Soffen

[57] ABSTRACT

Gasification device for a gas lighter: A container has an adjustment body installed to it and has a burner above the adjustment body. A porous mass is located in the container. An integral bottom closes the container. Grooves through the bottom permit liquid flow through the bottom, across the porous mass around the center needle projecting up from the container bottom and the gasified liquid exits through the burner.

5 Claims, 2 Drawing Figures

Fig. 1
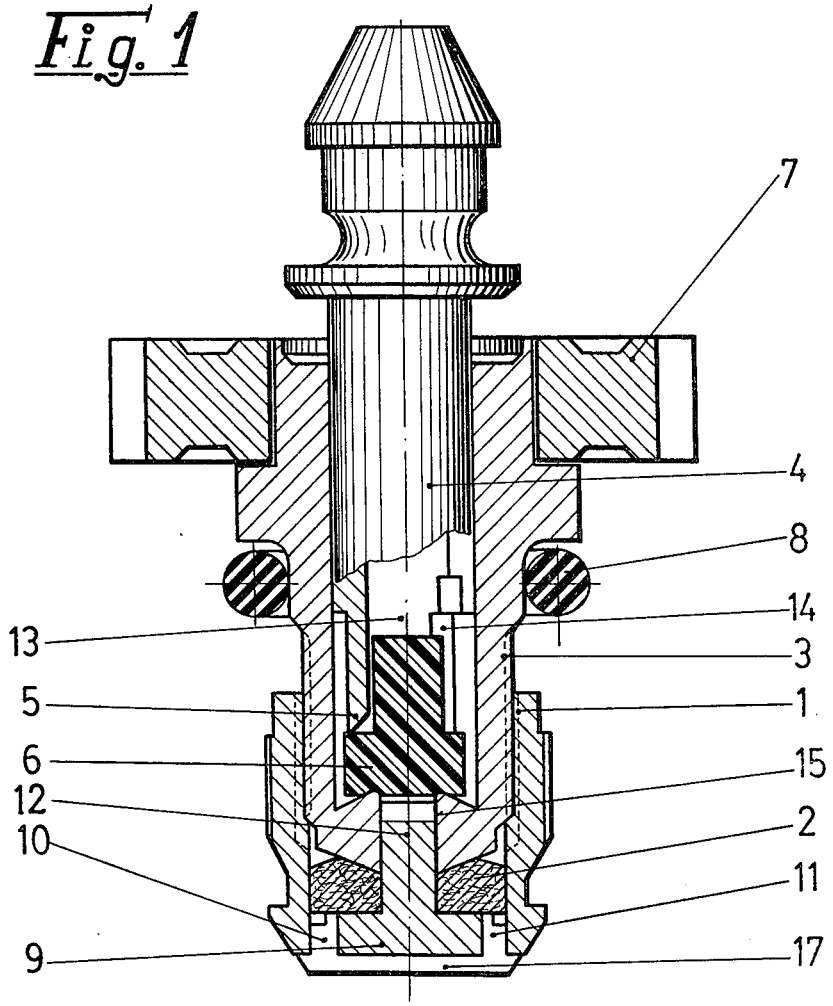
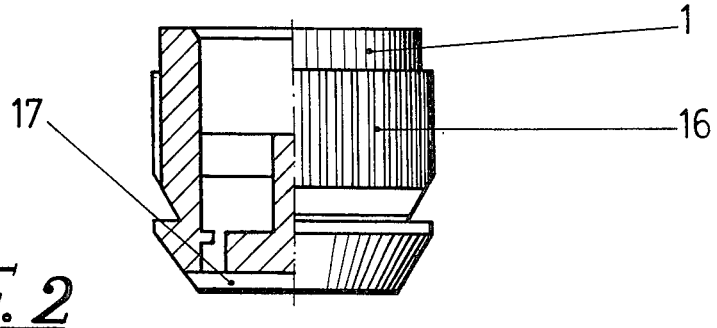
Fig. 2

ADJUSTMENT GASIFICATION DEVICE FOR GAS LIGHTERS

The invention concerns generally the manufacture of gas lighters; and more precisely, it includes an improved adjustment gasifier device, designed for lighters fed by liquid fuels, which device has been improved in its design, layout and assembly characteristics, to enable it to perform its work with maximum safety and efficiency. The proposed device is formed of a small number of parts which are easily constructed and assembled, which ensures that the said benefits of a practical and economic nature are achieved.

According to the invention, the body or container in which the said gasification device is arranged, has the setting point built into it.

This body, in its integral bottom part has a pair of passages formed by grooves through which the liquid fuel passes. The fuel is forced to cross a porous mass, optionally made of a material identified by the trademark "Nomex", to flow, through the center, around the setting needle or punch, which is an integral part of the bottom of the said body, and then, duly gasified, the fuel goes into the burner duct.

This new body-container of the gasifier is advantageous both in the practical and economic aspects, since the number of parts is reduced because their assembly is simplified.

At the present moment, this type of gasifier is made through two separate parts, occasionally assembled later. One of these parts forms the body or container and the other is made up of a discoidal strip with a needle or small punch in the center. The rest of the body is completely open at the bottom.

In the device of the present invention, one part is eliminated, which is the discoidal strip with the needle in the middle. This simplifies assembling the device.

A more complete idea of the object making up the present invention is given in the following description, in which, merely by way of example, the units and preferred details of the invention are commented on, referring to a practical case of embodiment.

In the drawings:

FIG. 1 is an elevation view, in a vertical plane cross-section, of an improved adjustment gasification device, according to the invention.

FIG. 2 is an elevation view, half in section through a vertical plane, of the body in which the device is arranged.

Referring to FIG. 1, we can see that the device proposed includes, altogether, the container -1-, the porous mass -2-, and the adjustment body -3- which simultaneously receives, in a sliding fashion, the burner -4-, which, in its inner end -5- has the resilient core -6- which acts as a valve thereby closing or opening the output of fuel gas.

Number -7- indicates a possible arrangement for setting the gas output. An O-ring 8 forms a practically air-tight fit between the device and the walls of the housing (not shown), provided in the lighter body, which housing receives the device as a whole.

The hollow body -1- offers the important innovation that its lower end -9-, is closed with an integral bottom -9- in which there are grooves -10- and -11- through which the liquid fuel flows from its storage location in the general vessel of the lighter. The fluid is forced to pass through the porous core -6- after flowing duly gasified, through the center, around the little punch or setting needle -12- and leaves the gasified fuel through the duct -13- of the burner -4-, to which it has access through its opening -14-.

The little punch -12- projects vertically from the bottom -9- of the body or container -1- of which it is an integral part, and is correctly placed in opposition to the middle passage -15- provided in the bottom of the body -3-, in which passage it is housed, so that on turning this body in one direction or another, a greater or smaller amount of gas is allowed to enter the burner.

In FIG. 2, we can see that the hollow body -1- has a peripheral grooving -16-, as well as a suitable outer configuration, to ensure that it is retained perfectly in the lighter body.

It can also be seen that the integral bottom -9- which closes the body -1-, has advantageously in its outer plane, a transverse groove -17- extending traversely of the tubular body across the bottom 9, in which the grooves -10- and -11- are included for the fuel to enter. The groove 17 assists the fuel in entering the gassifier body.

I claim:

1. Adjustable gasification device for a gas lighter, comprising:

a tubular cylindrical body for being contained in the body of a lighter; a burner located inside the tubular body;

an adjustment part inside the tubular body which is adjustable with respect to the tubular body and which is so placed and functions for controlling fluid flow to the burner;

the tubular body having a lower end; a bottom integral with the tubular body for closing the lower end of the tubular body; the bottom having passages through it from outside the tubular body through which fluid enters the tubular body and communicates to the adjustment part and thereafter communicates to the burner.

2. The gasification device of claim 1, wherein the bottom has an outwardly facing side to which the passages communicate, the outwardly facing side of the bottom has a groove defined in it which extends transversely across the bottom; the passages open into the transversely extending groove.

3. The gasification device of claim 1, further comprising a needle projecting up from the tubular body bottom;

a porous mass positioned above the bottom and inside the tubular body; the needle projecting through the porous mass; the porous mass being shaped and positioned for curbing fuel outlet;

the adjustment part being tubular in shape and having an opening into the bottom of its tubular shape; the needle from the tubular body bottom projecting into the bottom opening of the adjustment part, for adjusting the fuel flow through the adjustment part.

4. The gasification device of claim 3, wherein the adjustment part is annularly rotatable with respect to the tubular body for changing the orientation of the needle in the bottom opening of the adjustment part for adjusting the flow of fuel through the bottom opening.

5. The gasification device of claim 1, further comprising longitudinal grooving in the periphery of the tubular body for affixation purposes.

* * * * *